US011920273B2

(12) United States Patent
Lee et al.

(10) Patent No.: US 11,920,273 B2
(45) Date of Patent: Mar. 5, 2024

(54) LAUNDRY TREATING APPARATUS

(71) Applicant: LG ELECTRONICS INC., Seoul (KR)

(72) Inventors: Jihong Lee, Seoul (KR); Kwan Woong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 275 days.

(21) Appl. No.: 17/309,051

(22) PCT Filed: Oct. 11, 2019

(86) PCT No.: PCT/KR2019/013351
§ 371 (c)(1),
(2) Date: Apr. 16, 2021

(87) PCT Pub. No.: WO2020/085695
PCT Pub. Date: Apr. 30, 2020

(65) Prior Publication Data

US 2022/0034017 A1 Feb. 3, 2022

(30) Foreign Application Priority Data

Oct. 24, 2018 (KR) ..... 10-2018-0127531

(51) Int. Cl.
*D06F 34/20* (2020.01)
*D06F 33/32* (2020.01)
(Continued)

(52) U.S. Cl.
CPC ..... *D06F 34/20* (2020.02); *D06F 33/32* (2020.02); *D06F 37/18* (2013.01); *D06F 37/28* (2013.01);
(Continued)

(58) Field of Classification Search
CPC ..... D06F 34/20; D06F 37/18; D06F 37/28; D06F 37/42; D06F 33/32; D06F 39/14; D06F 2103/68
(Continued)

(56) References Cited

U.S. PATENT DOCUMENTS

2017/0002496 A1 1/2017 Lee
2017/0002498 A1 1/2017 Lee et al.

FOREIGN PATENT DOCUMENTS

JP 2014-012058 1/2014
WO WO 2007/119170 10/2007
WO WO 2014/061044 4/2014

OTHER PUBLICATIONS

International Search Report dated Feb. 10, 2020 in Korean Patent Application PCT/KR2019/013351.

*Primary Examiner* — Tinsae B Ayalew
(74) *Attorney, Agent, or Firm* — Birch, Stewart, Kolasch & Birch, LLP

(57) ABSTRACT

A laundry treating apparatus comprises: a cabinet having a top face for supporting an object thereon and a front face having a front opening communicating an interior of the cabinet with an outside; a drawer extendable from the cabinet through the front opening; a tub disposed inside the drawer and having a water storage space; a drum rotatably disposed in the tub to receive laundry; a laundry inlet in a top face of the tub to receive laundry; a lever having a fixed end pivotably coupled to the cabinet and a free end positioned between a top face of the cabinet and a top face of the drawer; a magnetic field generator fixed to one of the free end of the lever and the drawer; and a magnetic field sensor disposed on the other of the free end of the lever and the drawer.

13 Claims, 6 Drawing Sheets

(51) Int. Cl.

| | |
|---|---|
| ***D06F 37/18*** | (2006.01) |
| ***D06F 37/28*** | (2006.01) |
| ***D06F 37/42*** | (2006.01) |
| ***D06F 39/14*** | (2006.01) |
| *D06F 103/68* | (2020.01) |

(52) U.S. Cl.
CPC ..... *D06F 37/42* (2013.01); *D06F 39/14* (2013.01); *D06F 2103/68* (2020.02)

(58) Field of Classification Search
USPC ..... 68/12.01
See application file for complete search history.

LAUNDRY TREATING APPARATUS

TECHNICAL FIELD

The present disclosure relates to a laundry treating apparatus.

BACKGROUND

Generally, a laundry treating apparatus may refer to an apparatus for washing laundry, an apparatus for drying laundry, and/or an apparatus for performing washing and drying of laundry.

In the laundry loading apparatus of a front loading type (also known as drum washing machine) for inputting laundry to the laundry treating apparatus in front of the laundry treating apparatus, an laundry inlet provided for receiving the laundry is formed at a lower position than a level of a waist of the user. Thus, when the user puts the laundry into the laundry treating apparatus or draws the laundry out of the laundry treating apparatus, the user needs to bend his/her back. In order to remove such inconvenience, there was a conventional laundry treating apparatus to increase a height of the laundry inlet by adding a drawer type pedestal to a lower portion of the front loading type laundry treating apparatus.

Furthermore, in the conventional laundry treating apparatuses, the drawer-type pedestal is means not only for supporting a bottom surface of the laundry loading apparatus of the front loading type, but also for washing laundry or drying laundry.

The laundry treating apparatus of a drawer type should only be operated when the drawer is inserted into a cabinet. While the drawer is inserted inside the cabinet, a door to open and close a tub (which is provided in the drawer) should not be open. Therefore, the conventional laundry treating apparatus of the drawer type needs a sensor for detecting whether the drawer is inserted into the cabinet, and a sensor for detecting whether the door opens the laundry inlet when the drawer is received inside the cabinet.

Further, in the conventional laundry treating apparatus in the form of the drawer, a center of gravity moves along the drawer when the drawer is withdrawn from the cabinet. For this reason, the drawer type laundry treating apparatus may be tilted toward a direction in which the drawer is drawn out. To solve this problem, there was a sensor to detect whether another object such as a washing machine is seated on a top face of the cabinet.

SUMMARY

Technical Problem

One purpose of the present disclosure is to provide a drawer type laundry treating apparatus to support an apparatus (dryer, washing machine, combined washing and drying machine, etc.) for laundry treatment, but to be capable of washing or drying the laundry.

Further, another purpose of the present disclosure is to provide a laundry treating apparatus to use a single sensor to detect whether the drawer is inserted into the cabinet to a reference position, whether the door has opened the laundry inlet inside the cabinet, and whether an object is seated on the top face of the cabinet.

Solution to Problem

One aspect of the present disclosure proposes a laundry treating apparatus comprising: a cabinet having a top face for supporting an object thereon and a front face having a front opening defined therein communicating an interior of the cabinet with an outside thereof; a drawer extendable from the cabinet through the front opening; a tub disposed inside the drawer and having a water storage space defined therein; a drum rotatably disposed in the tub to receive therein laundry; a laundry inlet defined in a top face of the tub to receive laundry to be input into the drum; a lever having a fixed end pivotably coupled to the cabinet and a free end positioned between a top face of the cabinet and a top face of the drawer; a magnetic field generator fixed to one of the free end of the lever and the drawer to generate a magnetic field; a magnetic field sensor disposed on the other of the free end of the lever and the drawer, wherein the magnetic field sensor is configured to sense a magnetic field from the magnetic field generator when the drawer is inserted into the cabinet to a reference position; a lever actuator configured: when an object is seated on the top face of the cabinet, to allow the free end of the lever to move toward the drawer to keep a distance between the magnetic field generator and the magnetic field sensor to be a value smaller than or equal to a reference distance; or when the object does not rest on the top face of the cabinet, to allow the free end of the lever to pivot away from the drawer such that the distance between the magnetic field generator and the magnetic field sensor is larger than the reference distance; and a door pivotally disposed at a top face of the drawer or a top face of the tub to open and close the laundry inlet, wherein when the door opens the laundry inlet inside the cabinet, the lever actuator is configured to pivot the free end of the lever away from the drawer such that the distance between the magnetic field generator and the magnetic field sensor is larger than the reference distance.

In one implementation, the laundry treating apparatus further comprises: a driver to rotate the drum; and a controller configured to receive a control signal from the magnetic field sensor, and to operate the driver only when the distance between the magnetic field generator and the magnetic field sensor is smaller than or equal to the reference distance.

In one implementation, the lever actuator includes: a vertically reciprocating portion configured to contact an object seated on the top face of the cabinet and to reciprocate along a vertical direction of the cabinet depending on whether the object is seated on the top face of the cabinet; and a slide configured: when the object contacts the vertically reciprocating portion, to allow the free end of the lever to move toward the drawer; or when the object does not contact the vertically reciprocating portion, to allow the free end of the lever to move away from the drawer.

In one implementation, the vertically reciprocating portion includes: a vertically reciprocating body configured to penetrate the top face of the cabinet, wherein when the object is seated on the top face of the cabinet, the vertically reciprocating body moves toward the slide using a weight of the object, wherein the vertically reciprocating body moves away from the slide when the object is removed from the top face of the cabinet; a guide protrusion formed on one of the vertically reciprocating body and the slide; and a guide groove defined in the other of the vertically reciprocating body and the slide, wherein when the vertically reciprocating body moves toward the slide, the guide groove guides movement of the slide away from the lever.

In one implementation, the slide includes: a horizontally reciprocating body configured to move away from the lever when the object presses the vertically reciprocating body, and to move toward the lever when the object does not press the vertically reciprocating body; an actuating bar having one end fixed to the horizontally reciprocating body and performing a linear reciprocating motion; a conversion portion configured to convert the linear reciprocation motion of the actuating bar into a pivoting movement of the free end of the lever, wherein the conversion portion is configured: when the actuating bar moves away from the lever, to allow the distance between the magnetic field generator and the magnetic field sensor to be smaller than or equal to the reference distance; or when the actuating bar moves toward the lever, to allow the distance between the magnetic field generator and the magnetic field sensor to be larger than the reference distance.

In one implementation, the conversion portion includes: a first inclined face formed on the lever and inclined upwards toward the actuating bar; and a second inclined face formed on a free end of the actuating bar and in contact with the first inclined face, wherein the second inclined face is inclined downwards toward the lever.

In one implementation, the slide further includes a slide spring to press the horizontally reciprocating body toward the lever.

In one implementation, the lever actuator further includes at least one of: a first guide for guiding movement of the horizontally reciprocating body; or a second guide for guiding movement of the vertically reciprocating body.

In one implementation, the lever includes: a bar-shaped lever body having the fixed end and the free end; a lever rotation shaft disposed at the fixed end to define a rotation shaft for the lever body; a receiving portion disposed at the free end to receive the magnetic field generator therein; and a bent portion protruding from the lever body toward the door, wherein the bend portion contacts the door when the door pivots to open the laundry inlet.

In one implementation, the laundry treating apparatus further comprises: a base fixed to the cabinet and located above the laundry inlet, wherein the lever is supported on the base; a first through-hole passing through the base to expose the bent portion to an outside of the base; a second through-hole passing through the base to expose the receiving portion to an outside of the base; and a lever spring for pressing the bent portion toward the first through-hole.

In one implementation, the laundry treating apparatus further comprises a door pressing portion disposed on the base, wherein the door pressing portion is configured to prevent the door from interfering with the front opening when the drawer is withdrawn from the cabinet.

In one implementation, the door pressing portion includes at least one roller rotatably fixed to the base, wherein a distance from a top face of the cabinet to a bottom of the roller is configured to be larger than a distance from the top face of the cabinet to an edge of the front opening parallel to the top face of the drawer.

In one implementation, the laundry treating apparatus further comprises a lever guide protruding from the receiving portion; and a guide groove defined in the base to guide movement of the lever guide.

Technical Effects

In accordance with the present disclosure, a drawer type laundry treating apparatus to support an apparatus (dryer, washing machine, combined washing and drying machine, etc.) for laundry treatment, but to be capable of washing or drying the laundry may be realized.

Further, in accordance with the present disclosure, a laundry treating apparatus may use a single sensor to detect whether the drawer is inserted into the cabinet to a reference position, whether the door has opened the laundry inlet inside the cabinet, and whether an object is seated on the top face of the cabinet.

DETAILED DESCRIPTION

Hereinafter, a preferred embodiment of the laundry treating apparatus will be described in detail with reference to the accompanying drawings.

Figure 1:
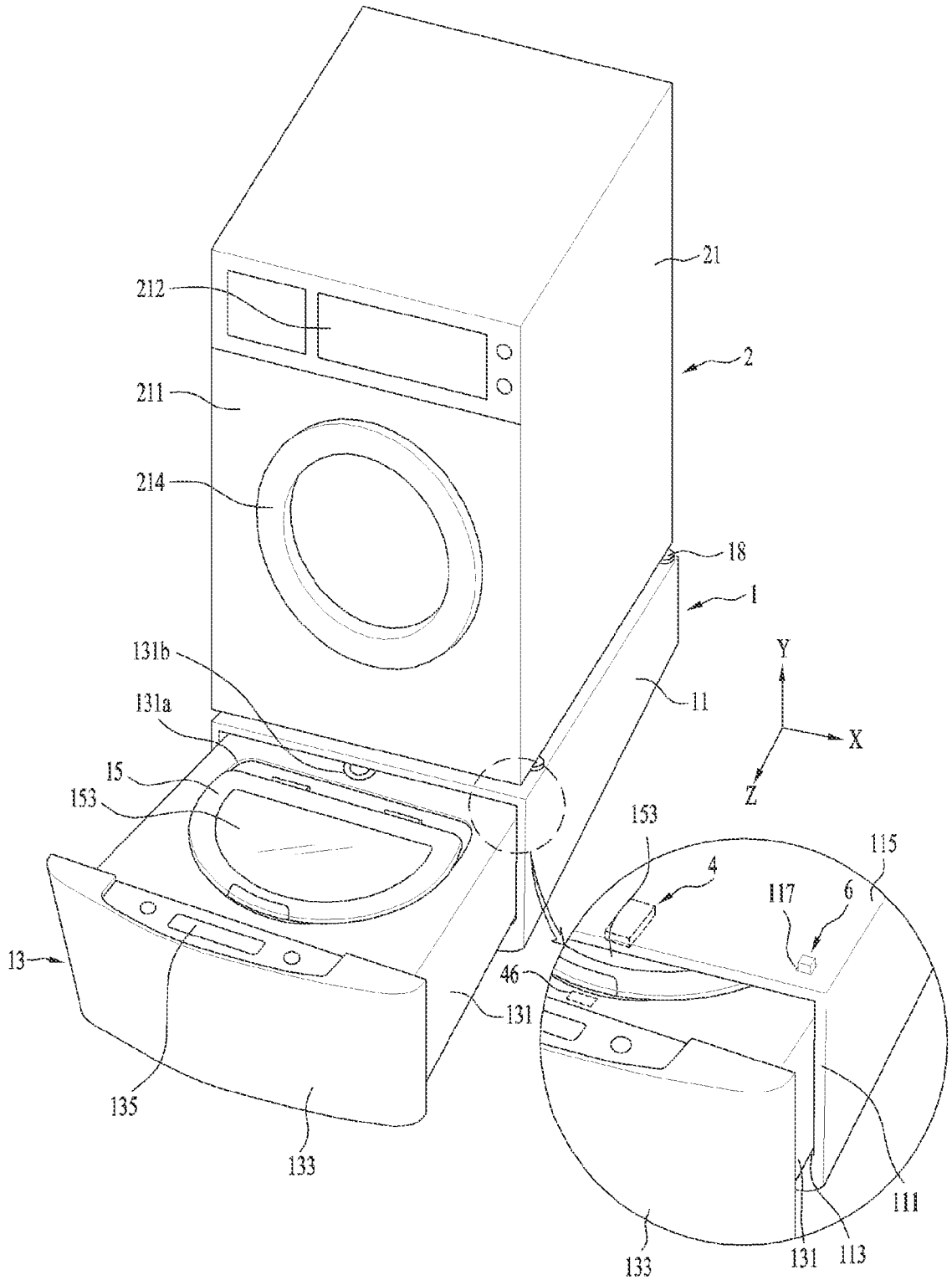
FIG. 1 and FIG. 2 show an example of a laundry treating apparatus.

As shown in FIG. 1, a laundry treating apparatus 100 may be provided as a first treating apparatus 1 capable of washing or drying the laundry as well as seating an object thereon. An object capable of resting on the first treating apparatus 1 and restraining vibration of the first treating apparatus 1 and maintaining the center of gravity of the first treating apparatus 1 may be a second treating apparatus 2 capable of washing or drying the laundry.

The first treating apparatus 1 includes a cabinet 11 which provides a space for supporting the second treating apparatus 2 (first cabinet 11), a drawer 13 extendable from the first cabinet, a tub 15 inside the drawer to provide a space for water storage (first tub 15), and a drum 17 rotatably inside the first tub to store laundry therein (first drum 17).

The first cabinet 11 may be provided in a hexahedral shape including a front face 111 with an inlet 113 and a top face 115 providing a space for receiving the second treating apparatus. The inlet 113 is provided to penetrate the front face and communicates the interior of the first cabinet 11 with the exterior thereof.

The drawer 13 includes a drawer body 131 that can be withdrawn from the first cabinet 11 through the inlet 113 or moved into the interior of the first cabinet 11, and a drawer panel 133 fixed to the drawer body 131 to open and close the inlet 113.

The drawer body 131 may be provided in a hexahedron shape. The top face of the drawer body may have a drawer first through-hole 131*a* and a drawer second through-hole 131*b* for communicating the inside of the drawer body 131 with the outside thereof.

The drawer first through-hole 131*a* may be means for feeding laundry to first drum 17. The drawer second through-hole 131*b* may be means to supply water to the first tub 15. Detailed descriptions thereof will be described later.

The drawer panel 133 is fixed to the front face of the drawer body 131 and located outside the first cabinet 11. The drawer panel 133 may act as a handle for the drawer body 131.

The drawer panel 133 may be provided in a shape capable of opening and closing the inlet 113. Opening the inlet 113 by the drawer panel 133 means that the drawer panel 133 is moved away from the front face 111 along a direction of the Z axis, thereby exposing the inlet 113 to the outside. Closing the inlet 113 by the drawer panel 133 means that the drawer body 131 is inserted into first cabinet 11 so that the inlet 113 is hidden by the drawer panel 133 and is not exposed to the outside.

The drawer panel 133 may further include a control panel 135 (first control panel 135). The first control panel 135 may include an input unit for receiving a control command from a user and a display unit for providing a user with information related to the operation of the first treating apparatus.

Figure 2:
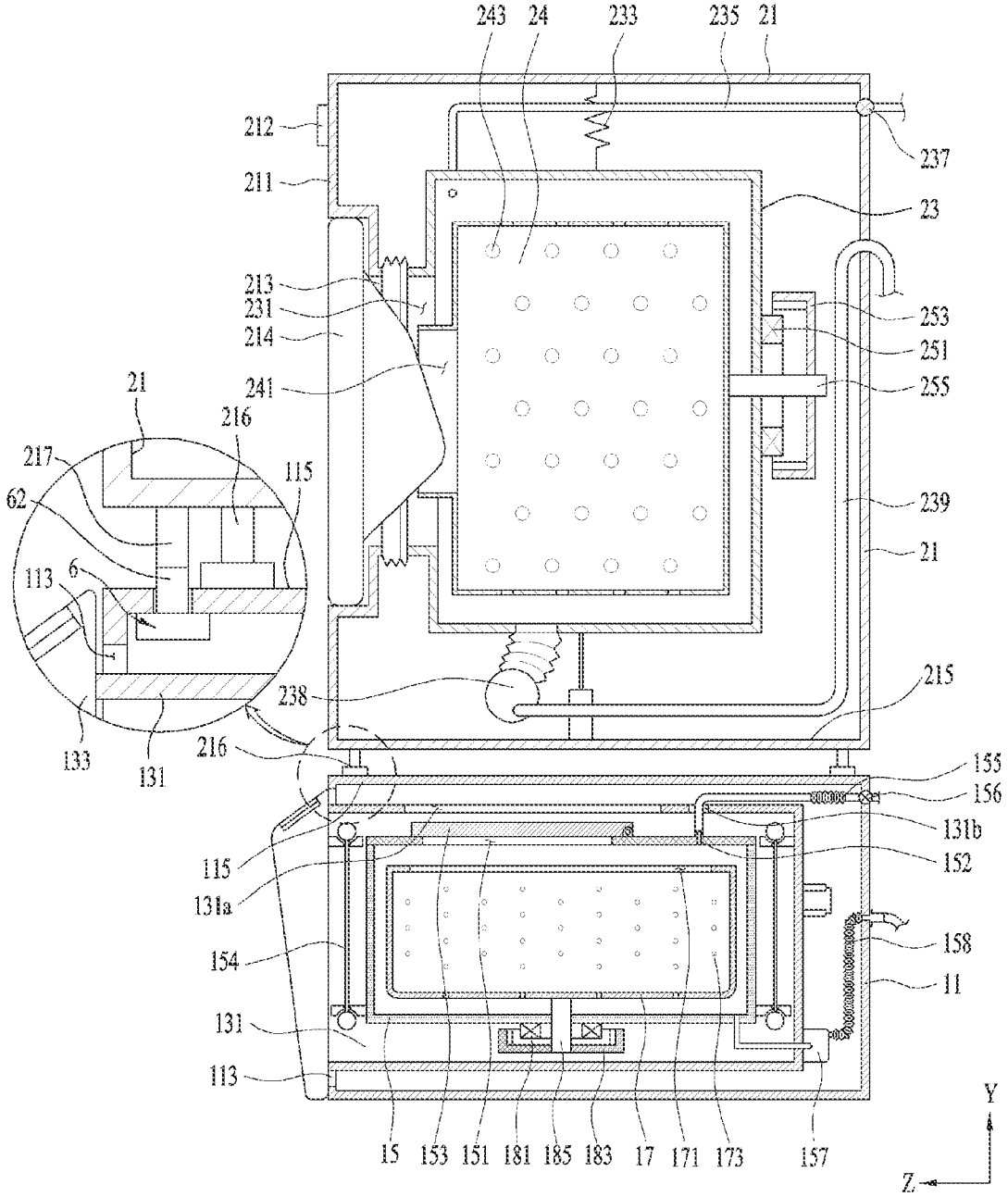

As shown in FIG. 2, the first tub 15 has a hollow cylindrical shape and may be fixed inside the drawer body 131 through the first tub support 154.

The top face of the first tub 15 may have a laundry inlet 151 (first laundry inlet 151), and a supply hole 152. The first laundry inlet 151 may be preferably located below the drawer first through-hole 131*a*. The supply hole 152 may be located below the drawer second through-hole 131*b*.

The first laundry inlet 151 is opened and closed by a door 153 (first door). The first door 153 may be pivotally fixed to the top face of the first tub 15, and may be pivotally fixed to the top face of the drawer body 131. FIG. 2 shows an example where the first door 153 is coupled to the top face of the first tub via a hinge. In this case, the first door 153 should be constructed to pivot away from the top face of the first tub 15 through the drawer first through-hole 131*a*.

The first tub 15 receives water through a water supply unit (first water supply unit). Water stored in the first tub 15 is discharged from the first tub via a water discharge unit (first water discharge unit).

The first water supply unit may include a first water supply pipe 155 inserted into the drawer second through-hole 131*b* to connect a water source (not shown) and the supply hole 152 with each other, and a first valve 156 to open and close the first water supply pipe 155 under control of a first controller (not shown). The first water discharge unit is configured to include a first water discharge pipe 158 which directs the water inside the first tub 15 to the outside of the first cabinet 11 and a first pump 157 which causes the water to move along the first water discharge pipe.

The drawer body 131 is configured to be movable along the longitudinal direction (Z axis) of the first cabinet 11. Thus, the first water supply pipe 155 and the first water discharge pipe 158 may be configured as a pipe having a varying length.

The first drum 17 may have a hollow cylindrical shape. The top face of the first drum includes a first drum laundry inlet 171 communicating with the first laundry inlet 151, and a communication hole 173 configured to penetrate the circumferential and bottom surfaces of the first drum. The first drum laundry inlet 171 is located under the first laundry inlet 151. Thus, the user may input the laundry to the first drum 17 through the drawer first through-hole 131*a*, first laundry inlet 151, and first drum laundry inlet 171.

The communication hole 173 may act as means for communicating the interior of the first drum 17 with the first tub 15. Thus, the water supplied to the first tub 15 is supplied to the laundry inside the first drum through the communication hole 173. Water and foreign matter remaining in the laundry may be discharged to the first tub 15 through the communication hole 173.

The first drum 17 rotates by a first driver. FIG. 2 shows an example where the first driver has a first stator 181, a first rotor 183 and a first rotation shaft 185. The first stator 181 act as means which is fixed to the bottom of the first tub 15 to form a rotation field. The first rotor 183 may act as means for rotating by the magnetic field. The first rotation shaft 185 is configured to penetrate the bottom of the first tub and acts as means for connecting the first drum 17 and the first rotor 183.

The second treating apparatus 2 may include a second cabinet 21 located on a top of the first cabinet 11, a second tub 23 located in the second cabinet 21 to provide a space for water storage, and a second drum 24 rotatably disposed inside the second tub to store therein laundry.

The second cabinet 21 includes a front panel 211 having a second laundry inlet 213, a base panel 215 forming a bottom surface, and a leg 216 supporting the second treating apparatus 2. The second laundry inlet 213 is opened and closed by a second door 214 pivotally coupled to the front panel 211. The front panel 211 may have a second control panel 212 (see FIG. 1). The second control panel may include a second input unit for receiving a control command from a user, and a second display unit for displaying information related to the operation of the second treating apparatus. Each of the legs 216 may be provided at each corner of the base panel 215 and may be seated on the top face 115 of the first cabinet.

The second tub 23 has a hollow cylindrical shape and has a second tub laundry inlet 231 communicating with the second laundry inlet 213 and defined in a front face thereof. The second tub laundry inlet 231 and the laundry inlet 213 may be connected to each other through a gasket provided in a form of a flexible pipe. This may prevent the water inside the second tub from draining into the second cabinet, and prevent the vibration of the second tub from being transmitted to the second cabinet.

The second tub 23 is secured inside the second cabinet 21 via a second tub support 233. The second tub support 233 may have a damper for fixing a lower part of the second tub to the base panel 215 and a spring for fixing an upper part of the second tub to the second cabinet 21.

The second tub 23 receives water through a second water supply unit. The second water supply unit may be configured to include a second water supply pipe for connecting water source to the second tub 23, and a second valve 237 which opens and closes the second water supply pipe 235 according to a control signal of a second controller (not shown).

The water stored in the second tub 23 is discharged out of the second cabinet 21 through the second water discharge unit. The second water discharge unit may be configured to include a second water discharge pipe 239 that directs the water inside the second tub 21 to the outside of the second cabinet 21, and a second pump 238 that causes the water to move along the second water discharge pipe 239.

The second drum 24 has a hollow cylindrical shape. In a front face thereof, there is defined a second drum laundry inlet 241 communicating with the second laundry inlet 213 of the second cabinet via the second tub laundry inlet 231. Further, the circumferential face, front face and rear face of the second drum 24 may have communication holes 243 for communicating the inside of the second drum with the inside of the second tub.

The second drum 24 is rotated by a second driver. The second driver may have a second stator 251 that is fixed to the back of the second tub to form a rotation magnetic field, a second rotor 253 rotatable by the field, and a rotation shaft 255 passing through the back face of the second tub and connecting the second drum 24 and the second rotor 253 with each other.

The embodiment as described above is based on the case where the second treating apparatus 2 is provided as an apparatus for washing laundry. The second treating apparatus 2 may be provided as an apparatus capable of drying laundry.

In this case, the second treating apparatus 2 may include a circulating duct which provides a flow path for drawing the air inside the second tub 23 to the outside and then resupplying the air to the second tub, a fan provided inside the circulating duct, and a heat exchanger that sequentially performs dehumidification and heating of the air introduced into the circulating duct.

In one example, the second treating apparatus 2 may be provided as an apparatus for the purpose of drying laundry. In this case, the second laundry treating apparatus 2 may be configured to include a second cabinet, a second drum rotatably provided inside the second cabinet, a circulating duct providing a flow path for supplying air to the second drum, a fan disposed inside the circulating duct, and a heat exchanger.

The flow path for supplying air to the second tub may include an exhaust duct for guiding air inside the second tub to the outside of the second cabinet and a supply duct for supplying air from an outside of the second cabinet to the second tub. In this case, the fan may be provided in the exhaust duct. The heat exchanger may be provided in the supply duct.

The laundry treating apparatus 100 may further include a integrated sensing unit 4 and 6 which detects whether the drawer 13 has been inserted into the first cabinet 11 up to a preset reference position, whether the first door 153 has opened the first laundry inlet 151 inside the first cabinet 11, and whether an object (second treating apparatus) is seated on the top face of the first cabinet 11.

Figure 3:
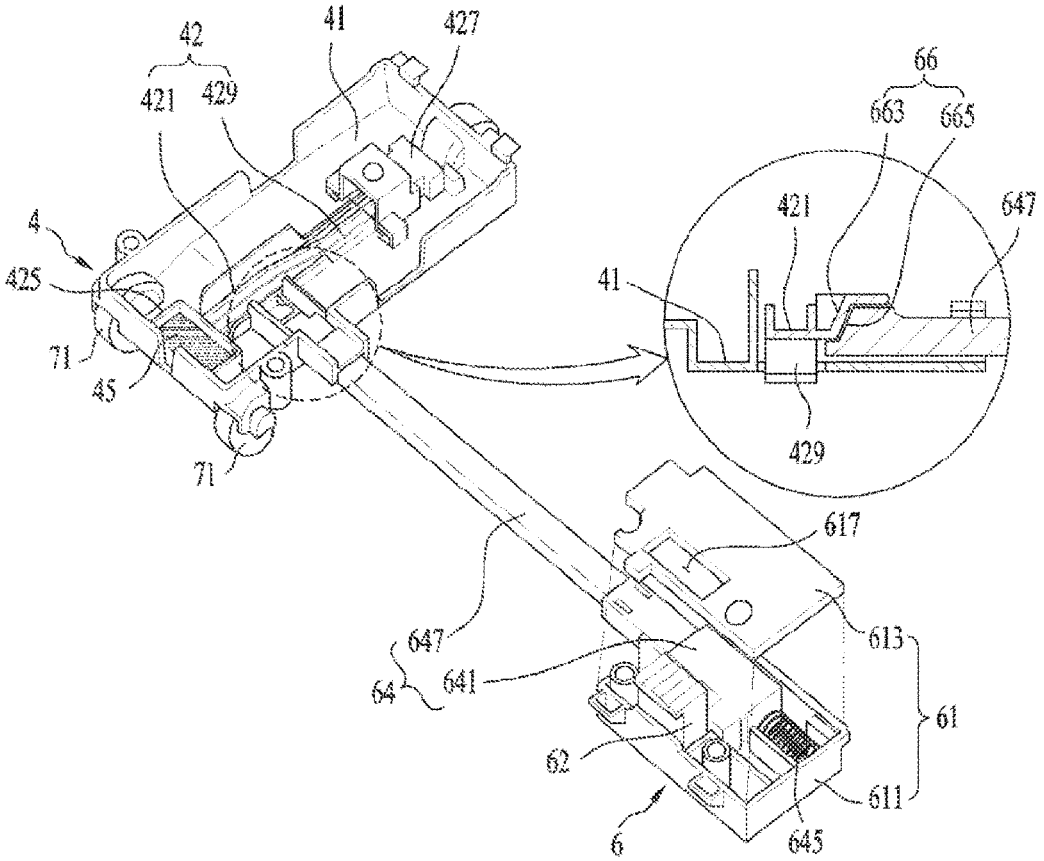
FIG. 3 illustrates an example of an integrated sensing unit provided in a laundry treating apparatus.

As shown in FIG. 3, the integrated sensing unit includes a signal generator 4 that generates a control signal, and a lever actuator 6 which causes the signal generator 4 to generate different control signals depending on whether the second treating apparatus 2 is seated on the top face 115 of the first cabinet The signal generator 4 includes a lever 42 having one end pivotally fixed inside the first cabinet 1 and positioned between the top face 115 of the first cabinet and the top face of the drawer body 131, a magnetic field sensor 45 fixed to one of the lever 42 and the top face of the drawer body 131, a magnetic field sensor 46 (see FIG. 1) provided on the other of the lever 45 and the top face of the drawer body 131.

The magnetic field generator 45 may act as means for generating a magnetic field like a permanent magnet. The magnetic field sensor 46 may act as means for detecting the magnetic field provided by the magnetic field generator, such as the Hall sensor. FIG. 3 shows one example where the magnetic field generator 45 is mounted on the lever 42 while the magnetic field sensor 46 is fixed to the drawer body 131.

Figure 4:
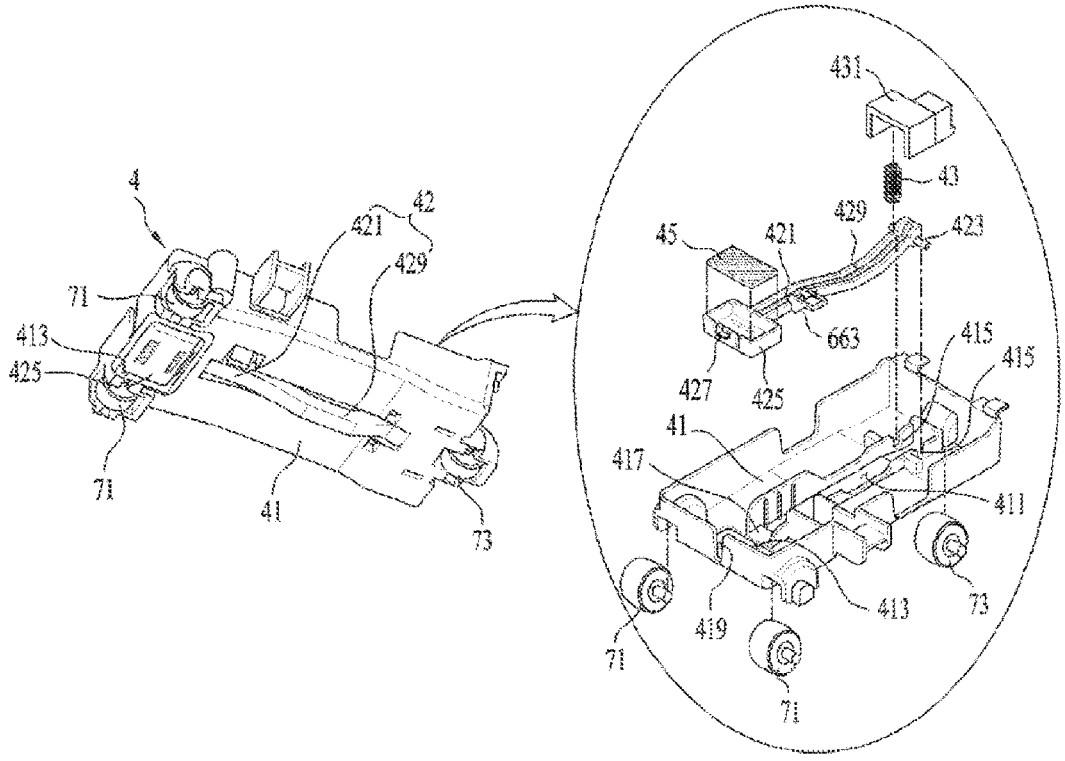
FIG. 4 shows an example of a signal generator included in an integrated sensing unit.

As shown in FIG. 4, the lever 42 may be provided in the form of a bar having a fixed end pivotally coupled to the first cabinet 11 and a free end located between the top face 115 of the first cabinet and the top face of the drawer body 131. That is, the lever 42 may include a bar shaped lever body 421 having a fixed end and a free end, and a lever rotation shaft 423 provided at the fixed end of the lever body 421, and a receiving portion 425 disposed at the free end of the lever body 421. The magnetic field generator 45 is fixed to the portion 425.

The lever body 421 is configured to pivot in a direction away from the top face of the drawer body 131 (toward the top face of the first cabinet) when the first door 153 pivots in the direction that the first door 153 opens the first laundry inlet 151 inside the first cabinet 11.

To facilitate the lever body 421 to pivot away from the drawer when the first door 153 opens the first laundry inlet 151 inside first cabinet 11, the lever body 421 may further include a bent portion 429 protruding toward the first door 153. The bent portion 429 may be positioned between the lever rotation shaft 423 and the receiving portion 425 and positioned on a top of the first door 153. In this case, when, inside the first cabinet 11, first door 153 pivots in the direction of opening the first laundry inlet 151, the first door 153 will press the bent portion 429 away from the drawer.

The lever 42 may further include a lever spring 43 which presses the free end of the lever body 421 toward the top face of the drawer body 131. Therefore, when the external force input to the lever body 421 through the bent portion 429 disappears, the free end of the lever body 421 will be moved towards the top face of the drawer body 131 by the lever spring 43.

The receiving portion 425 may be provided in any shape as long as the magnetic field generator 45 is received therein. FIG. 4 shows an example in which the receiving portion 425 is provided in the shape of a cube with an open top face. The receiving portion 425 may further include a receiving portion through-hole. Through the receiving portion through-hole, the magnetic field from the magnetic field generator 45 is discharged out of the receiving portion 425.

The lever 42 may be fastened directly to the first cabinet 11 via the lever rotation shaft 423, and may be pivotally fixed to a base 41 fixed to the first cabinet 11.

The base 41 is fixed to the first cabinet 11 and is located above the first laundry inlet 151. The distance between the lever body 421 and the top face of the drawer body 131 is kept constant by the base 41.

In a bottom face of the base 41, a base first through-hole 411 that exposes the bent portion 429 of the lever body 421 to the outside of the base 41 is defined. A base second through-hole 413 configured to penetrate the bottom of the base 41 to expose the receiving portion 425 to the outside of the base 41 is defined.

A lever support 417 may be provided between the base first through-hole 411 and the base second through-hole 413 to support the lever body 421. The lever support 417 may serve as means to establish an initial position of the lever body 421 (the position of the lever body when no force from the first door is input to the lever body).

The base 41 may further include a shaft receiving portion 415 in which the lever rotation shaft 423 is accommodated. The lever rotation shaft 423 inserted in the shaft receiving portion 415 is prevented from being pulled out of the shaft receiving portion 415 by a cover 431. The cover 431 may be detachably fixed to the base 41. In this case, the lever spring 43 may have one end secured to the cover 431, while the other end thereof may be fixed to the lever body 421. The other end of the lever spring 43 fixed to the lever body 42 is preferably located between the lever rotation shaft 423 and the receiving portion 42.

When the lever body 421 rests on the lever support 417 while the drawer body 131 is inserted in the first cabinet 11 to a preset reference position, a distance between the magnetic field generator 45 and the magnetic field sensor 46 will maintain a constant distance (reference distance), and thus the magnetic field sensor 46 will detect a magnetic field of a constant intensity (magnetic field of a reference intensity).

The reference position may be set to a position at which the magnetic field sensor 46 detects a magnetic field above the predetermined intensity (or a position at which the distance between the magnetic field generator and the magnetic field sensor is smaller than or equal to a predetermined distance. An example of the reference position may be a position where the drawer panel 133 closes the inlet 113.

Therefore, the first controller (not shown) may detect whether the drawer body 131 has moved to the reference position based on a control signal transmitted by the magnetic field sensor 46. That is, when the drawer body 131 is located at the reference position (when the drawer is inserted in the first cabinet), the intensity of the magnetic field detected by the magnetic field sensor 46 will be greater than the intensity of the magnetic field detected by the magnetic field sensor 46 when the drawer body 131 is not located in the reference position (when the drawer is withdrawn from the first cabinet). Thus, the laundry treating apparatus 100 may detect whether the drawer 13 is drawn out from the first cabinet 11 using the above-described signal generator 4.

Further, when the first door 153 opens the first laundry inlet 151 while the drawer body 131 is located at the reference position, the free end of the lever body 421 will pivot away from the top face of the drawer body 131. In this case, the distance between the magnetic field generator 45 and the magnetic field sensor 46 will be larger than the reference distance. Accordingly, the laundry treating apparatus 100 may detect whether the first door 153 opens the first laundry inlet 151 while the drawer body 131 is located at the reference position, using the above-described signal generator 4.

The first controller may be preferably configured to operate the first driver only when a spacing between the magnetic field generator 45 and the magnetic field sensor 46 is smaller than or equal to the reference distance (only when detecting a magnetic field above the reference intensity). The first drum 17 rotates only when the drawer body 131 is fully inserted into the first cabinet 11 and then the first door 153 closes the first laundry inlet 151. This may prevent the drawer from being drawn out of the first cabinet during operation of first treating apparatus 1, and prevent the water and laundry from being discharged to the first cabinet.

To guide the pivoting movement of the lever body 421, the lever 42 has a lever guide 427 protruding from the receiving portion 425. The base 41 may have a guide groove 419 which provides a path of movement of the lever guide 427. FIG. 4 shows one example where the lever guide 427 is placed in front of the receiving portion 425, and the guide groove 419 is provided in the front face of the base 41.

As shown in FIG. 3, the lever actuator 6 moves the free end of the lever body 421 toward the top face of the drawer body 131 when the second treating apparatus 2 is seated on the top 115 of the first cabinet. When the second treating apparatus 2 does not rest on the top face 115 of the first cabinet, the lever actuator 6 may be configured for moving the free end of the lever body 421 away from the top face of the drawer body 131. When the free end of the lever body 421 moves towards the top face of the drawer body 131, the distance between the magnetic field generator 45 and the magnetic field sensor 46 will be smaller than the reference distance. When the free end of the lever body 421 moves away from the top face of the drawer body 131, the distance between the magnetic field generator 45 and the magnetic field sensor 46 will be larger than the reference distance.

Figure 5:
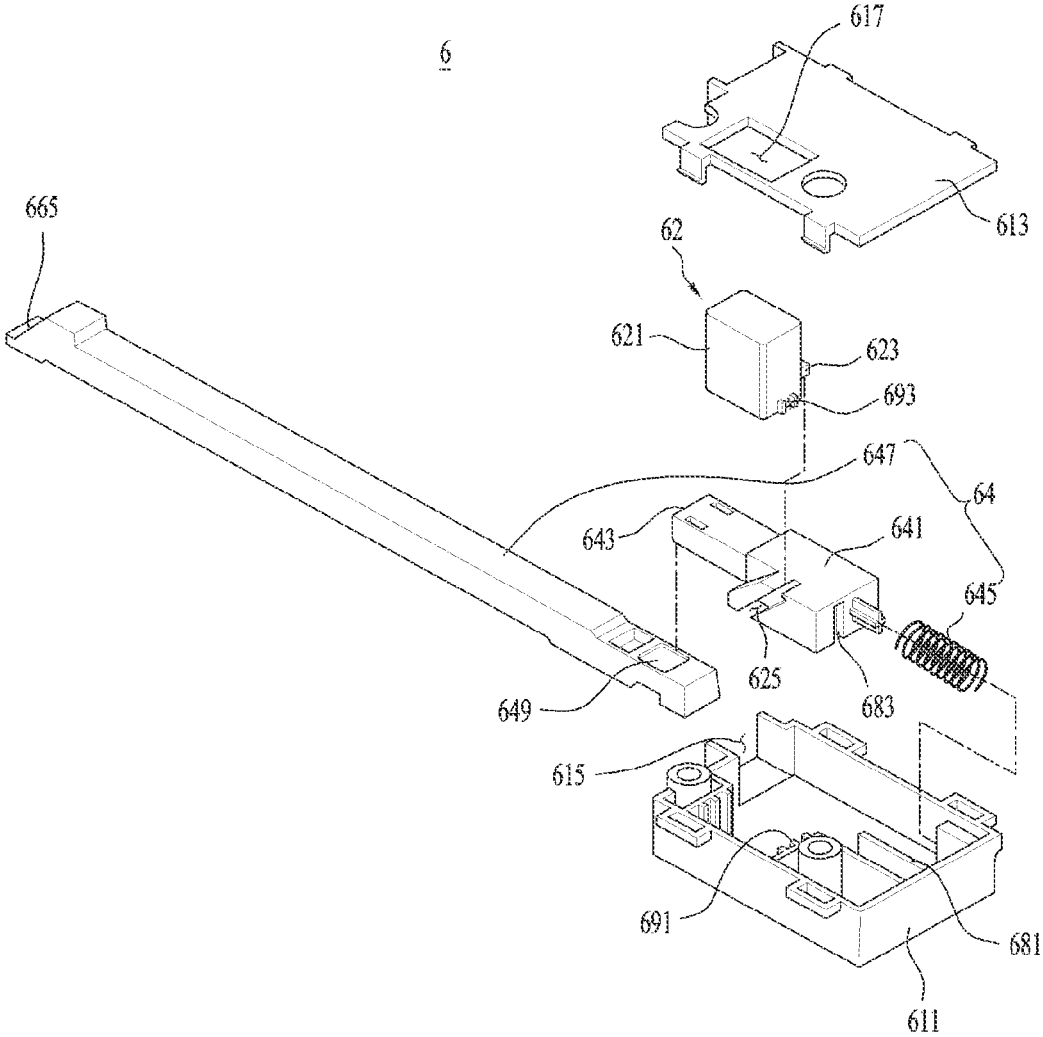
FIG. 5 shows an example of a lever actuator included in an integrated sensing unit.

As shown in FIG. 5, the lever actuator 6 may include a vertically reciprocating portion 62 configured to contact the second treating apparatus 2 seated on the top face 115 of the first cabinet, and a slide 64 to adjust the position of the free end of the lever body 421 depending on whether the second treating apparatus 2 is in contact with the vertically reciprocating portion 62.

The vertically reciprocating portion 62 is exposed to the top face 115 of the first cabinet 11 through the top face through-hole 117 defined in the top face of the first cabinet (see FIG. 1). The vertically reciprocating portion 62 is configured to reciprocate along a height (Y-axis) of the first cabinet, depending on whether the second treating apparatus 2 is seated on the top face 115. The slide 64 moves the free end of the lever body 421 toward the top face of the drawer body 131 when the second treating apparatus 2 is rested on the top face 115 of the first cabinet and contacts the vertically reciprocating portion 62. The slide 64 is configured to move the free end of the lever body 421 away from the top face of the drawer body 131 when the second treating apparatus 2 does not contact the vertically reciprocating portion 62.

The lever actuator 6 may further include a housing 61 which not only provides the movement path of the vertically reciprocating portion 62 and the movement path of the slide 64, but also maintains the engaged state of the slide and the vertically reciprocating portion 62.

The housing 61 is fixed to the first cabinet 11 and may have a housing body 611 and a housing cover 613. The housing body 611 is configured to provide a space for receiving the slide 64 therein. The housing cover 613 may be secured to an open top face of the housing body to form a top face of the housing 61.

A housing first through-hole 615 is defined in a face of the housing body 611 (facing toward the signal generator). The housing cover 613 has a housing second through-hole 617.

The vertically reciprocating portion 62 may include a vertically reciprocating body 621 having one end dispose inside the housing 61, and the other end exposed toward the top face 115 of the first cabinet through the housing second through-hole 617 and the top face through-hole 117 of the first cabinet. When the second treating apparatus 2 rests on the top face 115 of the first cabinet, the vertically reciprocating body 621 will move towards the slide 64 due to the weight of the second treating apparatus 621. However, when the second treating apparatus 2 is removed from the top face 115 of the first cabinet, the vertically reciprocating body 621 will move away from the slide 64.

The second treating apparatus 2 may further include a pressing portion 217, (see FIG. 2) which presses the vertically reciprocating body 621 toward the first cabinet when the second cabinet 21 is seated on the top face 115 of the first cabinet. The pressing portion 217 may be embodied as a protrusion protruding from the base panel 215.

The slide 64 may include a horizontally reciprocating body 641 horizontally reciprocating inside the housing 61 by the vertically reciprocating body 621. One end of the horizontally reciprocating body 641 is located inside the housing 61, while the other end thereof may be drawn out of the housing 61 through the housing first through-hole 615.

A guide protrusion 623 is disposed on one of the vertically reciprocating body 621 or the horizontally reciprocating body 641. The other one of the vertically reciprocating body 621 and the horizontally reciprocating body 641 has a groove 625 into which the protrusion 623 is inserted. The groove 625 may guide movement of the horizontally reciprocating body 641 into the housing 61 (in a direction away from the moving lever) when the vertically reciprocating body 621 moves toward the horizontally reciprocating body 641. When the vertically reciprocating body 621 moves away from the horizontally reciprocating body 641, the groove is configured to guide a movement of the horizontally reciprocating body 641 in the direction such that the body 641 is pulled out of the housing 61 (in a direction toward the lever).

The horizontally reciprocating body 641 receives resilience from a slide spring 645. The slide spring 645 is preferably embodied as a spring for pressing the horizontally reciprocating body 641 toward the housing second throughhole 617 (toward the lever). This allows the free end of the vertically reciprocating body 621 to remain exposed toward the top face 115 of the first cabinet.

The horizontally reciprocating body 641 is connected to the lever body 421 via an actuating bar 647. The actuating bar 647 may be integral to the horizontally reciprocating body 641. The horizontally reciprocating body 641 may be detachably coupled thereto. FIG. 5 shows an example in which the actuating bar 647 is attached to or detached from the horizontally reciprocating body 641. In this case, the assembly between the horizontally reciprocating body and the actuating bar will be easier. For fastening of the horizontally reciprocating body 641 with the actuating bar 647, the horizontally reciprocating body 641 has a bar-contacting portion 643, while the bar 647 has a slide-contacting portion 649.

The actuating bar 647 may perform the same motion as the horizontally reciprocating body 641. That is, when the horizontally reciprocating body 641 is moved inside the housing 61 by the vertically reciprocating body 621, the actuating bar 647 will move away from the lever. However, when the horizontally reciprocating body 641 is moved to be pulled out from the housing 61 by the vertically reciprocating body 621, the actuating bar 647 will move toward the lever body 421.

The linear reciprocating motion of the actuating bar 647 is converted to the pivoting motion of the lever body 421 via a conversion portion. When the bar 647 moves away from the lever body 421, the conversion portion may allow the spacing between the magnetic field generator 45 and the magnetic field sensor 46 to be smaller than or equal to the reference distance. When the actuating bar 647 moves towards the lever body 421, the conversion portion may allow the spacing between the magnetic field generator 45 and the magnetic field sensor 46 to be larger than the reference distance.

FIG. 3 shows an example of the conversion portion 66. The conversion portion 66 according to the present embodiment may include a lever inclined face 663 formed on the lever body 421 and a bar inclined face 665 formed on the free end of the actuating bar 647 and contacting the lever inclined face 663. The lever inclined face 663 is inclined upwards towards the actuating bar 647, while the bar inclined face 665 may be inclined downwards toward the lever body 421.

When the second treating apparatus 2 is not located on the top face 115 of the first cabinet, the horizontally reciprocating body 641 is urged to be drawn out of the housing 61 via the slide spring 645. The actuating bar 647 is pressed by the horizontally reciprocating body 641 toward the lever body 421. Thus, when the second treating apparatus 2 does not rest on the top face 115 of the first cabinet, the free end of the lever body 421 pivots away from the top face of the drawer body 131. This will keep the spacing between the magnetic field generator 45 and the magnetic field sensor 46 longer than the reference distance.

As shown in FIG. 5, the lever actuator 6 may further include a slide guide a vertically reciprocating portion guide for providing movement paths of the horizontally reciprocating body 641 and the vertically reciprocating body 621 respectively.

The slide guide may include a first protrusion 681 (provided along the width direction of the first cabinet) provided parallel to the moving path of the horizontally reciprocating body on the housing body 611, and a first protrusion receiving groove 683 defined in the horizontally reciprocating body 641 to accommodate the first protrusion therein.

The vertically reciprocating portion guide includes a second protrusion 691 provided on the housing body 611 (along the height direction of the first cabinet) provided parallel to the movement path of the vertically reciprocating body, and a second protrusion receiving groove 693 defined in the vertically reciprocating body 621 to receive the second protrusion therein.

Hereinafter, an operation of the integrated sensing unit 4 and 6 will be described with reference to FIGS. 6 to 10.

Figure 6:
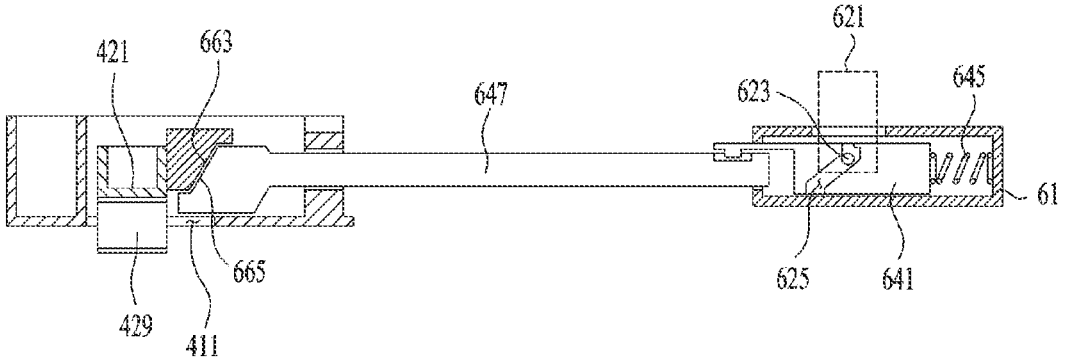
FIG. 6 and FIG. 7 show a position of the lever actuator and signal generator when no object is seated on a top face of the cabinet.

As shown in FIG. 6, no external force will be input to the vertically reciprocating body 621 unless an object such as the second treating apparatus 2 is placed on the top face 115 of the first cabinet. Thus, the horizontally reciprocating body 641 and the actuating bar 647 will be pushed toward the lever body 421 by the slide spring 645.

When the actuating bar 647 is pressed toward the lever body 421, the free end of the lever body 421 will pivot in a direction away from the top face of the drawer body 131 due to the shapes of the lever inclined face 663 and bar inclined face 665.

Figure 7:
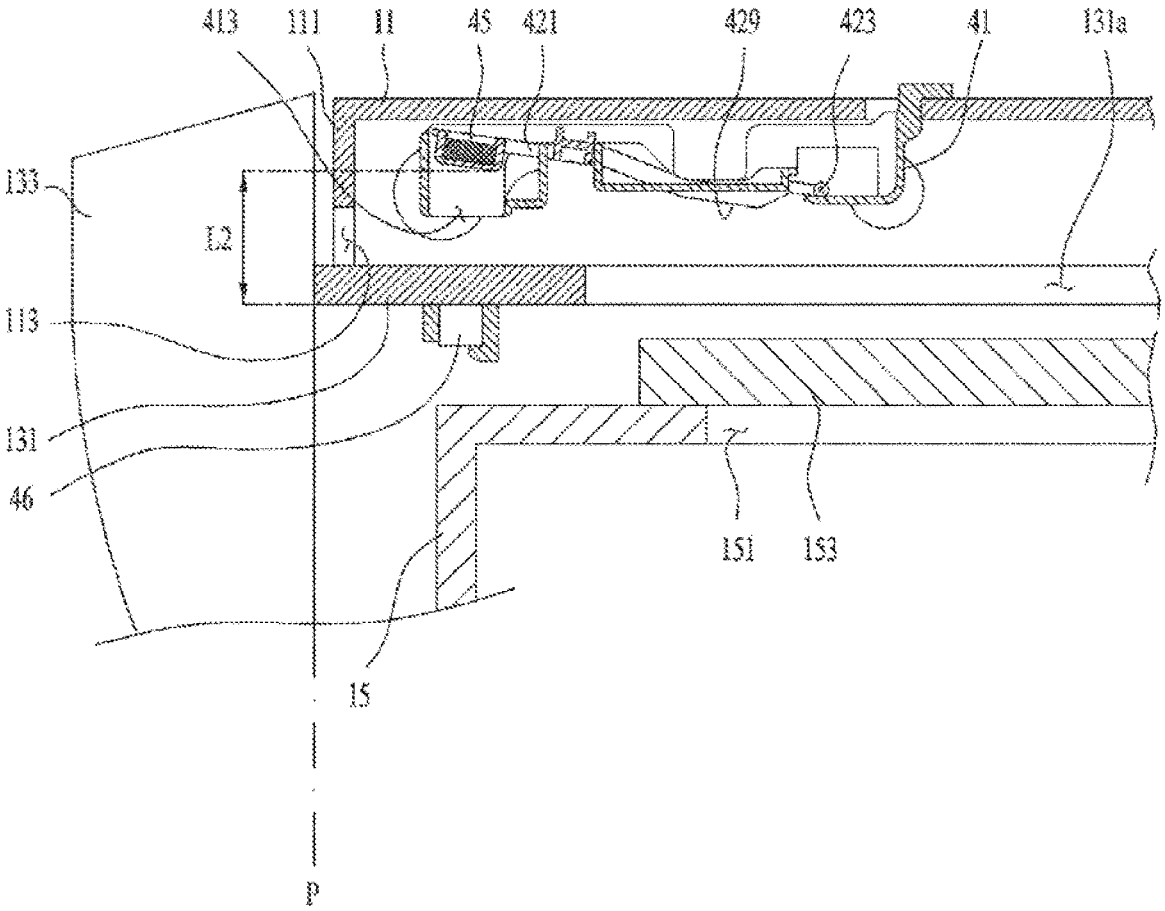

That is, when an object such as the second treating apparatus 2 does not rest on the top face 115 of the first cabinet, and even when the drawer body 131 has moved to the reference position P, the distance L2 between the magnetic field generator 45 and the magnetic field sensor 46 will remain longer than the reference distance (see FIG. 7). Thus, the magnetic field sensor 46 will detect a magnetic field of an intensity smaller than the reference intensity detected when the magnetic field generator 45 is within the reference distance.

Figure 8:
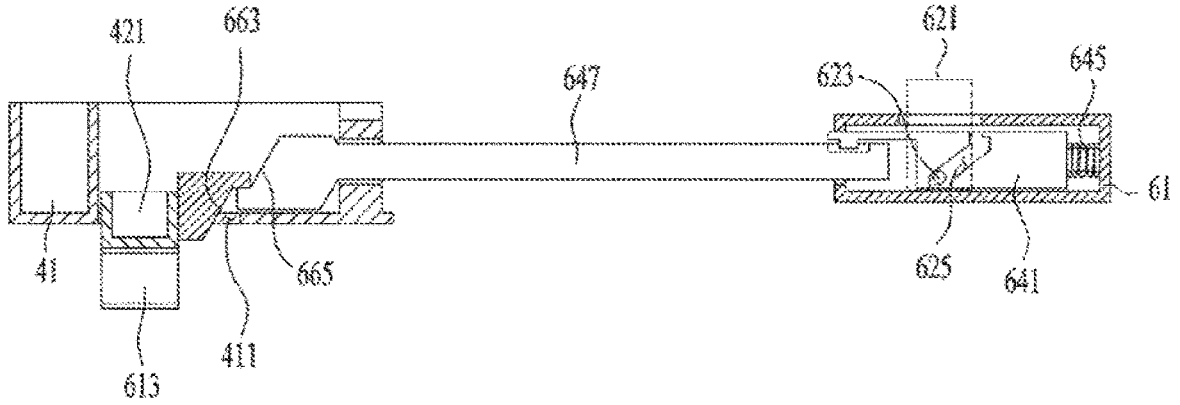
FIG. 8 and FIG. 9 show a position of the lever actuator and signal generator when the object rests on the top face of the cabinet.

In one example, as shown in FIG. 8, when the second treating apparatus 2 is seated on the top face 115 of the first cabinet, the vertically reciprocating body 621 is moved into the first cabinet 11 by the pressing portion 217 provided in the second treating apparatus. When the vertically reciprocating body 621 moves towards the interior of the first cabinet 11, the horizontally reciprocating body 641 and the actuating bar 647 will move away from the lever body 421 due to the protrusion 623 and the groove 625. In this process, the slide spring 645 is compressed inside the housing body 611.

Figure 9:
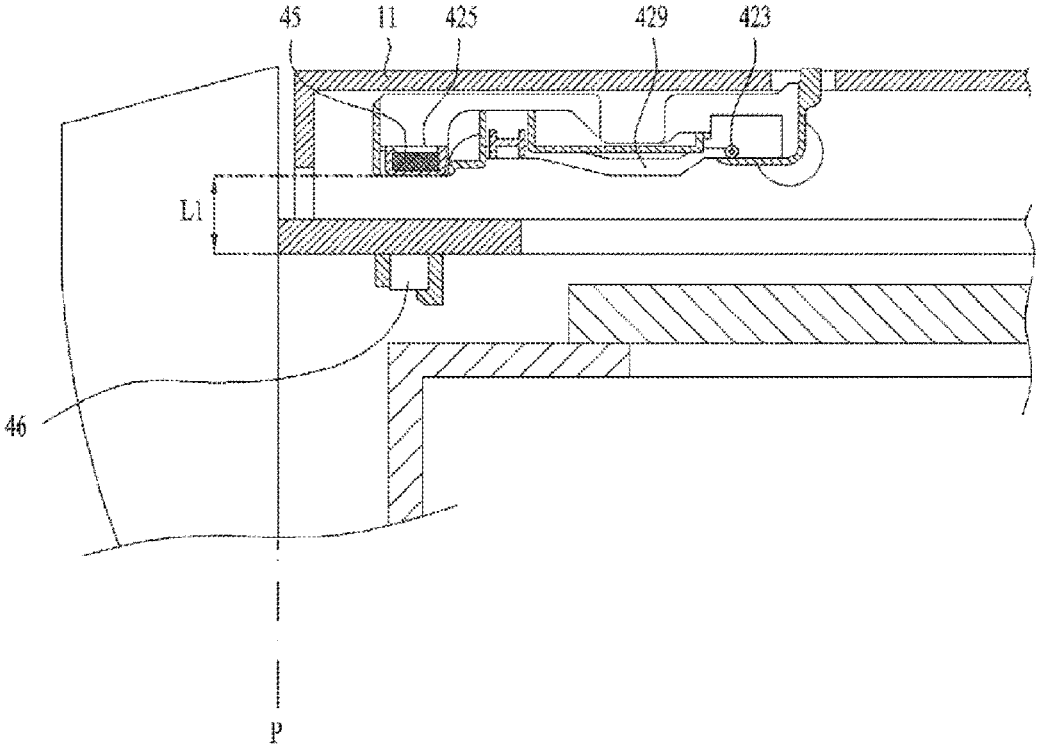

When the actuating bar 647 moves away from the lever body 421, the free end of the lever body 421 moves toward the top face of the drawer body 131 because of the geometry of the lever inclined face 663 and bar inclined face 665. Thus, as shown in FIG. 9, the distance between the magnetic field generator 45 and the magnetic field sensor 46 maintains the reference distance L1. The magnetic field sensor 46 will detect the magnetic field of the reference intensity.

Figure 10:
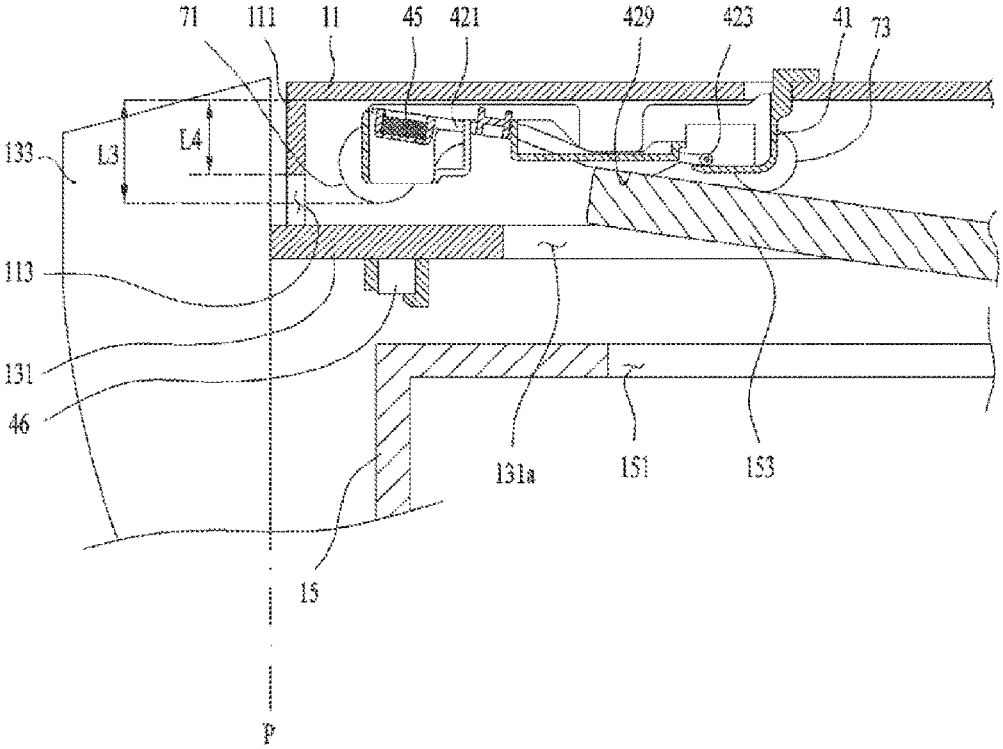
FIG. 10 shows the position of the lever actuator and signal generator when a door opens an laundry inlet inside the cabinet.

In this state, when the first door 153 pivots in the direction of opening the first laundry inlet 151, the lever body 421 pivots away from the top face of the drawer body 131. That is, as shown in FIG. 10, when the first door 153 opens the first laundry inlet 151 while the drawer body 131 has moved to the reference position P, the first door 153 will press the bent portion 429 and move the free end of the lever body 421 away from the top face of the drawer body 131.

When the first door 153 is opened inside the first cabinet 11, the drawer body 131 may not be drawn out of the first cabinet 11. This is because the first door 153 may interfere with the inlet 113 when the drawer body 131 is withdrawn from first cabinet 11.

To solve the problem that the drawer body 131 is not drawn from the first cabinet due to the first door 153, the laundry treating apparatus 100 may further include a door pressing portion 7 disposed on the base 41 to prevent the first door 153 from interfering with the inlet 113.

The door pressing portion 7 may include at least one roller rotatably fixed to the base 41. FIG. 10 shows an example in which the roller includes a first roller 71 provided in front of the base 41 and a second roller 73 provided in rear of the base 41. A distance L3 from the top face 115 of the first cabinet to the bottom of each roller 73 and 75 should be set to be larger than a distance L4 from the top face 115 of the first cabinet to an edge of the inlet 113 (that is, an edge portion of the inlet parallel to a top face of the drawer body).

In the laundry treating apparatus 100 having the above-described structure, when the first controller (not shown) receives a control signal that the magnetic field sensor 46 detects a magnetic field above a reference intensity, the first controller (not shown) may determine that the drawer body 131 has moved to the reference position P, the second treating apparatus 2 rests on the top face 115 of the first cabinet, and the first door 153 closes the first laundry inlet 151. Therefore, when a user's request is input to the input unit of the first control panel 135, the first controller controls the first driver, the first valve 156, and the first pump 157 to proceed with the laundry.

However, when the first controller receives a control signal that the magnetic field sensor 46 detects a magnetic field of an intensity lower than the reference intensity, the first controller notifies the user of an error message through a display unit provided in the first control panel 135. The magnetic field sensor 46 detecting a magnetic field with an intensity lower than the reference intensity may indicate that the drawer body 131 does not move to the reference position, the second treating apparatus 2 is not seated on the top face of the first cabinet, or the first door 153 is opened in the first cabinet. The error message may be of a text or sound type. Therefore, the laundry treating apparatus has an effect capable of detecting the above three states by only one magnetic field generator and one magnetic field sensor.

The laundry treating apparatus as described above may be modified and implemented in various forms. Thus, the scope of the present disclosure is not limited to the above-described embodiments.

What is claimed is:

1. A laundry treating apparatus comprising:

a cabinet having a top face for supporting an object thereon and a front face having a front opening defined therein communicating an interior of the cabinet with an outside thereof;

a drawer extendable from the cabinet through the front opening;

a tub disposed inside the drawer and having a water storage space defined therein;

a drum rotatably disposed in the tub to receive therein laundry;

a laundry inlet defined in a top face of the tub to receive laundry to be input into the drum;

a lever having a fixed end pivotably coupled to the cabinet and a free end positioned between a top face of the cabinet and a top face of the drawer;

a magnetic field generator fixed to one of the free end of the lever and the drawer to generate a magnetic field;

a magnetic field sensor disposed on the other of the free end of the lever and the drawer, wherein the magnetic field sensor is configured to sense a magnetic field from the magnetic field generator when the drawer is inserted into the cabinet to a reference position;

a lever actuator configured:

when an object is seated on the top face of the cabinet, to allow the free end of the lever to move toward the drawer to keep a distance between the magnetic field generator and the magnetic field sensor to be a value smaller than or equal to a reference distance; or when the object does not rest on the top face of the cabinet, to allow the free end of the lever to pivot away from the drawer such that the distance between the magnetic field generator and the magnetic field sensor is larger than the reference distance; and a door pivotally disposed at a top face of the drawer or a top face of the tub to open and close the laundry inlet, wherein when the door opens the laundry inlet inside the cabinet, the lever actuator is configured to pivot the free end of the lever away from the drawer such that the distance between the magnetic field generator and the magnetic field sensor is larger than the reference distance.

2. The laundry treating apparatus of claim 1, wherein the laundry treating apparatus further comprises:

a driver to rotate the drum; and a controller configured to receive a control signal from the magnetic field sensor, and to operate the driver only when the distance between the magnetic field generator and the magnetic field sensor is smaller than or equal to the reference distance.

3. The laundry treating apparatus of claim 2, wherein the lever actuator includes:

a vertically reciprocating portion configured to contact the object seated on the top face of the cabinet and to reciprocate along a vertical direction of the cabinet depending on whether the object is seated on the top face of the cabinet; and a slide configured:

when the object contacts the vertically reciprocating portion, to allow the free end of the lever to move toward the drawer; or when the object does not contact the vertically reciprocating portion, to allow the free end of the lever to move away from the drawer.

4. The laundry treating apparatus of claim 3, wherein the vertically reciprocating portion includes:

a vertically reciprocating body configured to penetrate the top face of the cabinet, wherein when the object is seated on the top face of the cabinet, the vertically reciprocating body moves toward the slide using a weight of the object, wherein the vertically reciprocating body moves away from the slide when the object is removed from the top face of the cabinet;

a guide protrusion formed on one of the vertically reciprocating body and the slide; and a guide groove defined in the other of the vertically reciprocating body and the slide, wherein when the vertically reciprocating body moves toward the slide, the guide groove guides movement of the slide away from the lever.

5. The laundry treating apparatus of claim 4, wherein the slide includes: a horizontally reciprocating body configured to move away from the lever when the object presses the vertically reciprocating body, and to move toward the lever when the object does not press the vertically reciprocating body;

an actuating bar having one end fixed to the horizontally reciprocating body and performing a linear reciprocating motion;

a conversion portion configured to convert the linear reciprocation motion of the actuating bar into a pivoting movement of the free end of the lever, wherein the conversion portion is configured:

when the actuating bar moves away from the lever, to allow the distance between the magnetic field generator and the magnetic field sensor to be smaller than or equal to the reference distance; or when the actuating bar moves toward the lever, to allow the distance between the magnetic field generator and the magnetic field sensor to be larger than the reference distance.

6. The laundry treating apparatus of claim 5, wherein the conversion portion includes:

a first inclined face formed on the lever and inclined upwards toward the actuating bar; and a second inclined face formed on a free end of the actuating bar and in contact with the first inclined face, wherein the second inclined face is inclined downwards toward the lever.

7. The laundry treating apparatus of claim 6, wherein the slide further includes a slide spring to press the horizontally reciprocating body toward the lever.

8. The laundry treating apparatus of claim 5, wherein the lever actuator further includes at least one of:

a first guide for guiding movement of the horizontally reciprocating body; or a second guide for guiding movement of the vertically reciprocating body.

9. The laundry treating apparatus of claim 2, wherein the lever includes:

a bar-shaped lever body having the fixed end and the free end;

a lever rotation shaft disposed at the fixed end to define a rotation shaft for the lever body;

a receiving portion disposed at the free end to receive the magnetic field generator therein; and a bent portion protruding from the lever body toward the door, wherein the bent portion contacts the door when the door pivots to open the laundry inlet.

10. The laundry treating apparatus of claim 9, wherein the laundry treating apparatus further comprises:

a base fixed to the cabinet and located above the laundry inlet, wherein the lever is supported on the base;

a first through-hole passing through the base to expose the bent portion to an outside of the base;

a second through-hole passing through the base to expose the receiving portion to an outside of the base; and a lever spring for pressing the bent portion toward the first through-hole.

11. The laundry treating apparatus of claim 10, wherein the laundry treating apparatus further comprises a door pressing portion disposed on the base, wherein the door pressing portion is configured to prevent the door from interfering with the front opening when the drawer is withdrawn from the cabinet.

12. The laundry treating apparatus of claim 11, wherein the door pressing portion includes at least one roller rotatably fixed to the base, wherein a distance from a top face of the cabinet to a bottom of the roller is configured to be larger than a distance from the top face of the cabinet to an edge of the front opening parallel to the top face of the drawer.

13. The laundry treating apparatus of claim 10, wherein the laundry treating apparatus further comprises a lever guide protruding from the receiving portion; and a guide groove defined in the base to guide movement of the lever guide.

* * * * *